US006035774A

United States Patent [19]

Fischer

[11] Patent Number: 6,035,774

[45] Date of Patent: Mar. 14, 2000

[54] BAND TENSIONING DEVICE ON A STRAPPING MACHINE

[75] Inventor: Charles Fischer, Wohlen, Switzerland

[73] Assignee: Strapex Holding AG, Stansstad, Switzerland

[21] Appl. No.: 09/263,197

[22] Filed: Mar. 5, 1999

[30] Foreign Application Priority Data

Mar. 9, 1998 [CH] Switzerland ..... 0551/98

[51] Int. Cl.[7] ..... B65B 13/22

[52] U.S. Cl. ..... 100/32; 53/589

[58] Field of Search ..... 100/26, 29, 32, 100/33 PB; 53/589

[56] References Cited

U.S. PATENT DOCUMENTS

| | | | |
|---|---|---|---|
| 1,988,534 | 1/1935 | Abbott | 100/29 |
| 2,730,036 | 1/1956 | Cheesman | 100/32 |
| 3,327,618 | 6/1967 | Cook | 100/26 |
| 3,396,889 | 8/1968 | Annis, Jr. | 100/26 |
| 3,577,909 | 5/1971 | Takano et al. | 100/26 |
| 5,024,149 | 6/1991 | Kato | 100/32 |
| 5,117,615 | 6/1992 | Kung et al. | 100/32 |
| 5,299,407 | 4/1994 | Schuttler et al. | 100/29 |
| 5,791,238 | 8/1998 | Garbotz | 100/32 |

FOREIGN PATENT DOCUMENTS

| | | | |
|---|---|---|---|
| 1152662 | 8/1963 | Germany | 100/32 |

*Primary Examiner*—Stephen F. Gerrity
*Attorney, Agent, or Firm*—Oblon, Spivak, McClelland, Maier & Neustadt, P.C.

[57] ABSTRACT

A tensioning device for tensioning the plastic band. The device has a tensioning element which can be rotated about an axis and has a flat gripping region. A clamping element is also mounted such that it can be rotated about the axis and, when the tensioning element is in the inoperative position, is supported against a stop. In this position, the plastic band can be moved freely between the gripping surface of the clamping element and the tensioning element. To tension the plastic band, the tensioning element is rotated in the tensioning direction and the gripping region of the tensioning element is thereby moved against the gripping surface so that the plastic band is held in a planar manner. With the plastic band being held, the gripping region, as seen in the tensioning direction and with respect to the axis, is inclined inwardly in the radial direction. During further rotation of the tensioning element the plastic band which is clamped between the tensioning element and the clamping element is tensioned.

13 Claims, 6 Drawing Sheets

BAND TENSIONING DEVICE ON A STRAPPING MACHINE

BACKGROUND OF THE INVENTION

1. Field of the Invention

The present invention relates to a tensioning device for tensioning a plastic band.

2. Discussion of the Background

Tensioning devices for strapping machines are intended to tension a plastic band, which is guided around an article to be strapped and is tightened against it to a predetermined tensile stress so that the band bears snugly against the article to be strapped. Strapping machines currently produced have a tensioning device with a tensioning element which is designed in the manner of a roller. This tensioning element is arranged on a shaft connected to a driving motor, and is designed to have a flattened portion in one sector on its circumference. That edge of the flattened portion which is at the rear in the direction in which the tensioning element is rotated to tension the plastic band forms a gripping location for the plastic band. A convex gripping surface of a clamping element interacts with this gripping location to hold the plastic band. The clamping element is mounted eccentrically on the tensioning element with respect to the axis thereof With increasing tensioning force the clamping action on the plastic band between the gripping surface and the flattened gripping location increases. If very high tensioning forces are required, this can lead to the plastic band being damaged.

SUMMARY OF THE INVENTION

An object of the present invention is therefore to provide a tensioning device of the type which, with a simple design, gently holds the plastic band, but permits high tensioning forces.

Since the gripping location is designed as a planar gripping region and the gripping region is arranged parallel to the gripping surface when clamping the plastic band, the clamping and holding of the plastic band along only one line is avoided, which makes it possible for high clamping forces to be applied with the plastic band being treated gently.

In one preferred embodiment of the tensioning device, the gripping surface is automatically directed parallel to the gripping region when the plastic band is gripped.

A structurally simple embodiment of the tensioning device includes the plastic band being held by being moved toward the clamping element which remains in the same place.

A further preferred embodiment of the tensioning device makes it possible for the plastic band to be optimally held and clamped.

Another embodiment includes a further measure for optimally introducing the forces into the plastic band.

A further preferred embodiment of the tensioning device ensures, that when the tensioning element is in the inoperative position, there is a large distance between the gripping region and the gripping surface so that the plastic band which is guided in between them can move freely with a large amount of play.

The tensioning device additionally results in the non-positive retaining of the clamping band between the gripping surface and the gripping region to give a positive engagement.

BRIEF DESCRIPTION OF THE DRAWINGS

The invention is explained in more detail with reference to an exemplary embodiment represented in the drawing, in which, purely schematically.

DETAILED DESCRIPTION OF THE PREFERRED EMBODIMENTS

Figure 1:
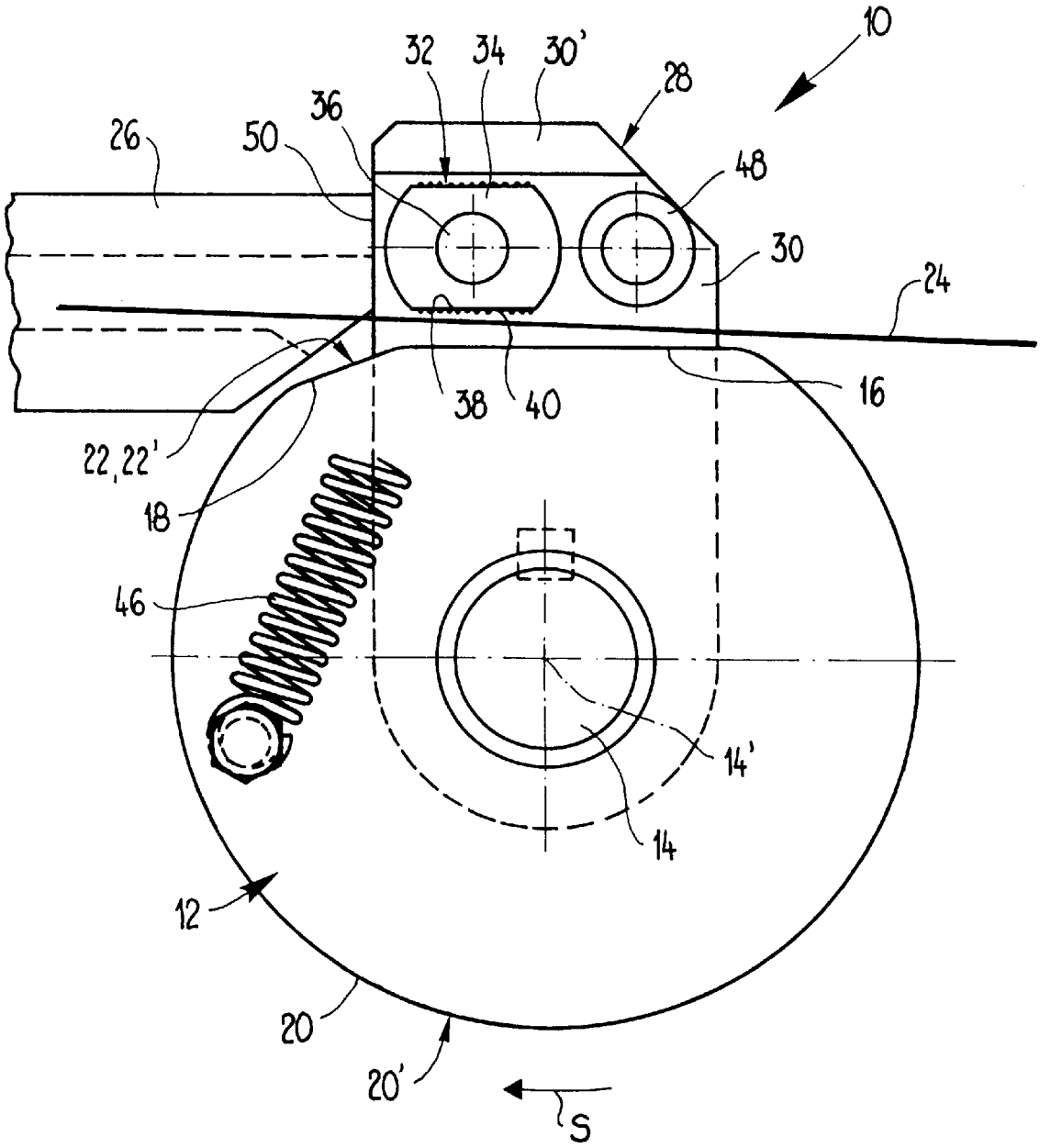
FIG. 1 is a side view of a tensioning device in which the tensioning element and the clamping element can be rotated about a common axis, in the inoperative state.

As FIGS. 1 to 4 reveal, the tensioning device 10 has a tensioning element 12 which is designed in the form of a roller or a disk and is secured by a wedge on a shaft 14, the axis of which is denoted by 14'. The shaft 14 is connected to a driving motor, not shown, with a gear mechanism which is intended to rotate the tensioning element 12 about its axis 14' from the inoperative position (shown FIG. 1) in the tensioning direction S into a tensioning position and then, in the opposite direction, back again into the inoperative position.

The tensioning element 12 has two adjoining flat regions 16, 18 which, for their part, adjoin the circular cylindrical section 20 of the circumferencial surface 20' of the tensioning element 12. The flat region 18, which is at the rear of the two, as seen in the tensioning direction S, forms a gripping location 22', designed as a planar gripping region 22, for a plastic band 24 which is to be tensioned.

A guide channel 26 which is rectangular in cross section and in which is carried the plastic band 24 is mounted upstream of the tensioning element 12. The longitudinal direction of the guide channel 26 runs at right angles to the axis 14', and the guide channel 26 extends approximately in the tangential direction with respect to the circumferential surface 20'.

The tensioning element 12 is embraced by a bracket 28 which is mounted in a freely rotatable manner on the shaft 14, with its two legs 30 on either side of the tensioning element 12. Between the web 30', which connects the two legs 30 to one another, and the tensioning element 12 there is arranged a clamping element 32. This has a clamping body 34 through which a bearing spindle 36 passes which runs parallel to the axis 14' and is supported by the legs 30. Two opposite surfaces of the clamping body 34 are designed as flat gripping surfaces 38 over which rows of gripping teeth 40 protrude. The gripping surface 38 which faces the tensioning element 20 is in each case used for clamping, and the gripping surface 38 which faces the web 30' interacts therewith to limit the rotation of the clamping body 34 which is mounted rotatably on the bearing spindle 36. In order to dampen the relative movement between the bearing spindle 36 and the clamping body 34, the bearing spindle has two peripheral annular grooves 42 in each of which is situated an O-ring in which the clamping body 34 is frictionally seated.

A stub of the bearing spindle 36, which protrudes beyond the relevant leg 30, has fastened to it one end of a tensile spring 46 whose other end is connected to the tensioning element 12. The tensile spring 46 acts on the clamping element 32 with a spring force which acts counter to the tensioning direction.

In the tensioning direction S downstream of the clamping body 34 a guide roller 48 is mounted in a freely rotatable manner on the legs 30, likewise between the web 30' and the tensioning element 12. This guide roller serves to deflect, in a manner which is harmless to the material, that section of the plastic band 24 which extends from the tensioning element 12 when the tensioning element 12 is at a great rotational angle during the tensioning of the plastic band 24.

In the inoperative position (shown in FIG. 1) of the tensioning element 12, its first flat region 16 is arranged in the longitudinal direction of the guide channel 26, and the bracket 28 abuts under spring force against the end of the guide channel 26, which end thus forms a stop 50 which supports the clamping element 32. The active gripping surface 38 and the first flat region 16 lie opposite one another and delimit a passage for the plastic band 24 in which the band can move freely in the longitudinal direction with play.

Figure 2:
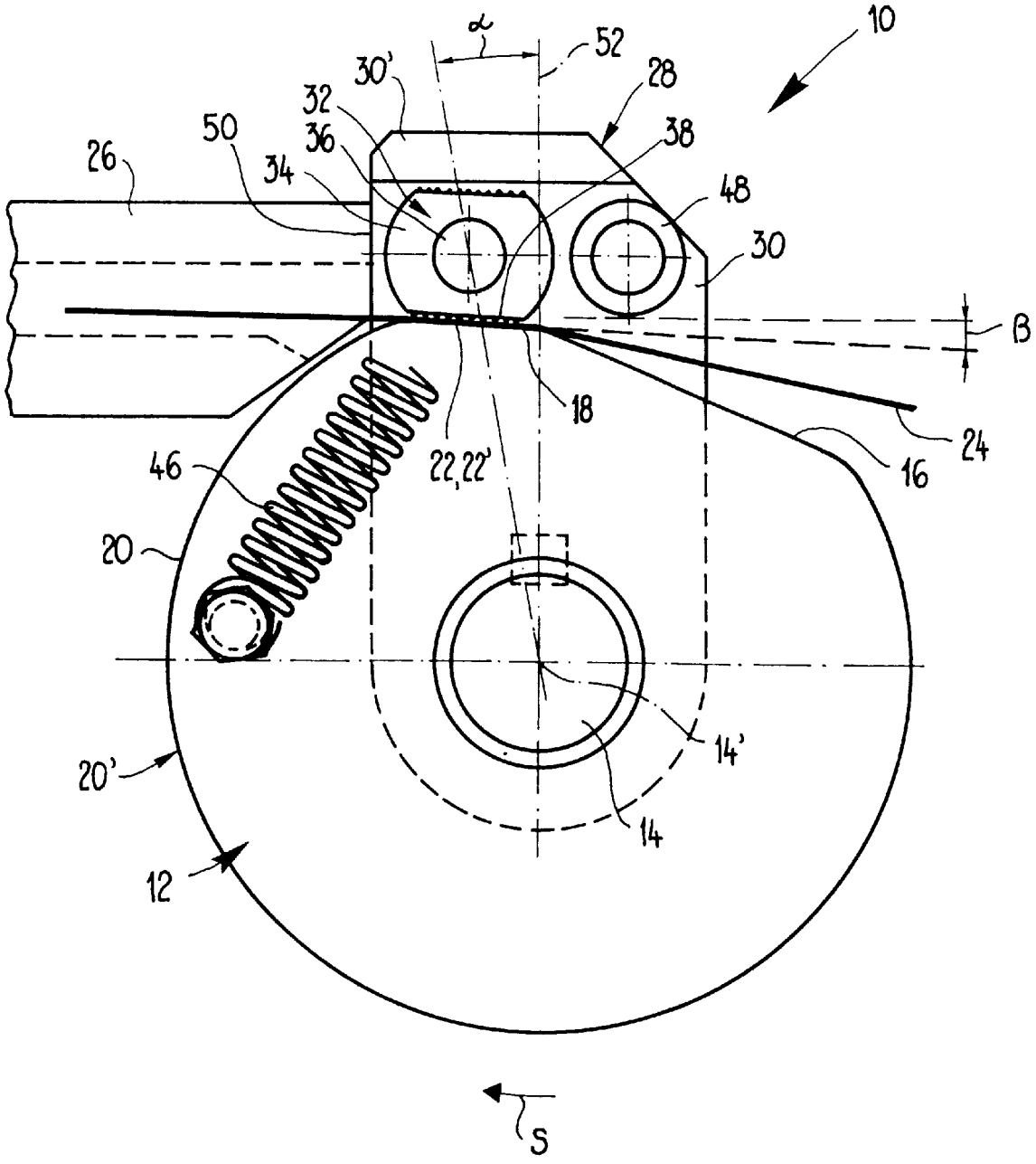
FIG. 2 is likewise a side view of the tensioning device of FIG. 1 at the moment when the tensioning element and the clamping element grip the plastic band to be tensioned.
Figure 3:
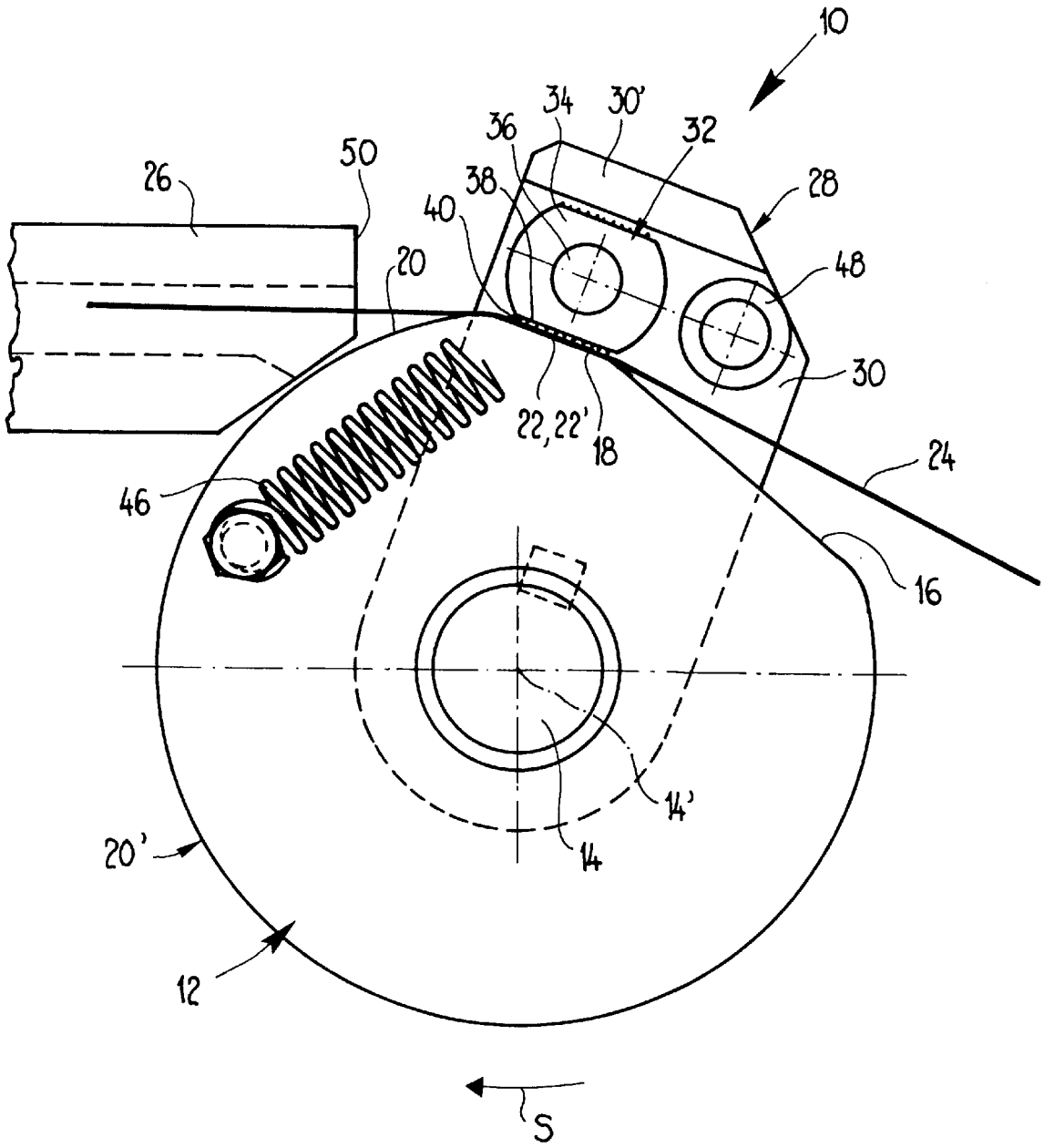
FIG. 3 is likewise a side view of the tensioning device shown in FIGS. 1 and 2 in a position during tensioning of the plastic band.
Figure 4:
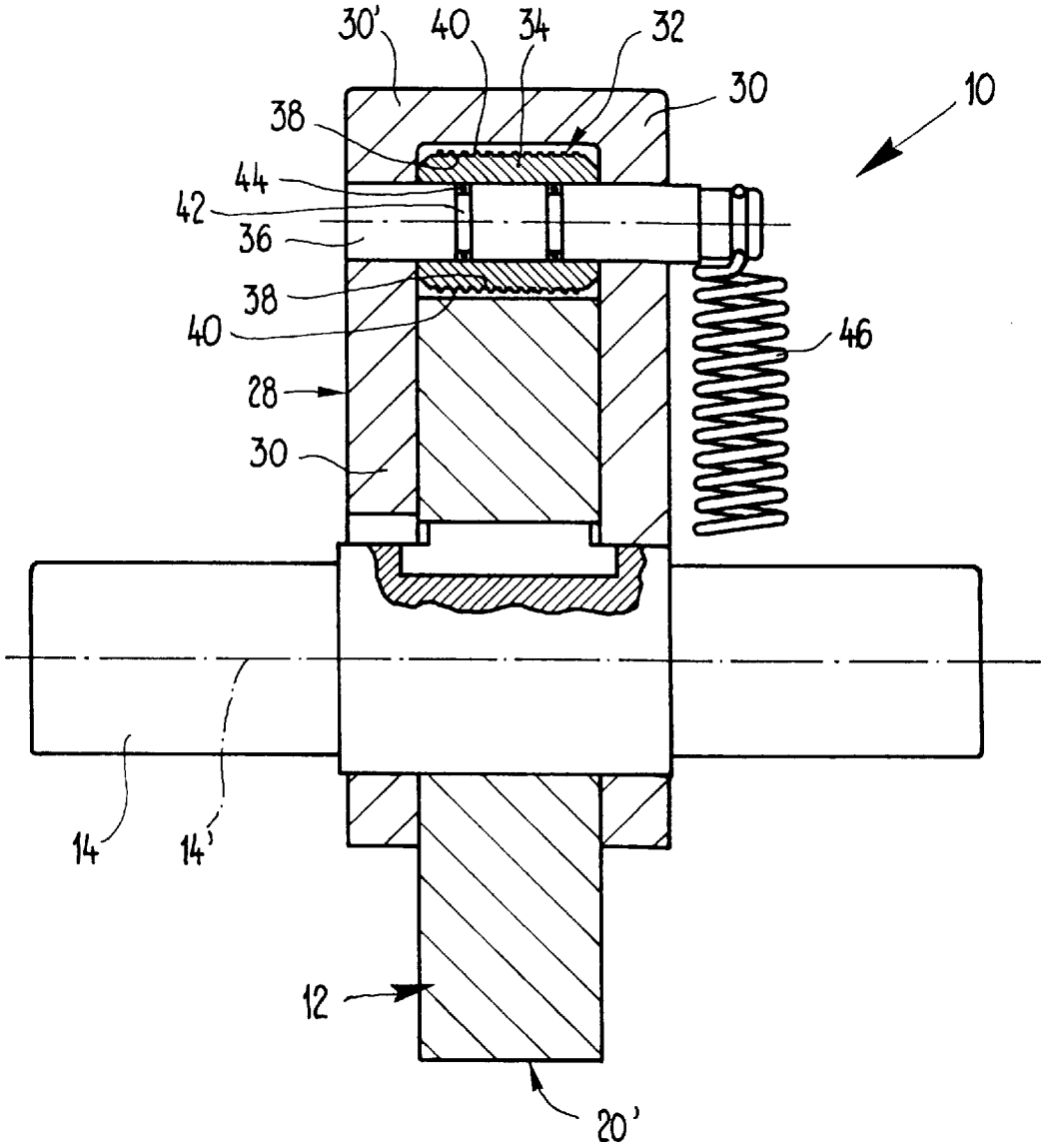
FIG. 4 is a partially broken away cross section through the tensioning element of the tensioning device and the rotatably mounted clamping element.

As can be seen in FIG.2, when the clamping element 32 is supported against the stop 50, the bearing spindle 36 trails a perpendicular line 52, which runs through the axis 14', with respect to the longitudinal direction of the guide channel 36 and thus at least approximately with respect to the plastic band 24 in the tensioning direction S. The trailing angle, which is denoted by $\alpha$, can be in the region of a few degrees, and is preferably approximately 10°. This arrangement of the clamping element 32 has the advantage that the passage for the plastic band 24 is of a considerable size, as measured in the radial direction, and the gripping surface 38 moves smoothly onto the plastic band 24 when the tensioning element 12 is rotated in the tensioning direction S. This trailing angle $\alpha$ further assists the optimum production of clamping force.

It can be further seen in FIG. 2 that at the time that the plastic band 24 is gripped by the gripping region 22 of the tensioning element 12 and the gripping surface 38 of the clamping element 32, the gripping region 22—as seen with respect to the longitudinal direction of the guide channel 26 and thus at least approximately of the advancing plastic band 24 and also in the tensioning direction S—is inclined inwardly in the radial direction by a specified angle $\beta$. The angle $\beta$ is in the range of from 1° to 5°, preferably from 1.5° to 4°, in particular around 2.5°. The inclination of the gripping region 22, and thus of the gripping surface 38 parallel thereto, further assists the optimum introduction of the force into the plastic band 24 and the maximum clamping action of the tensioning element 12 and clamping element 32 on the plastic band 24.

In the rotational position (shown in FIG. 3) of the tensioning element 12, the plastic band 24 is clamped between the gripping region 22 and the gripping surface 38 and the clamping element 32, as a result of being moved in the tensioning direction S, has moved away from the stop 50. The plastic band 24 now runs tangentially to the circular cylindrical section of the circumferential surface 20'.

Figure 5:
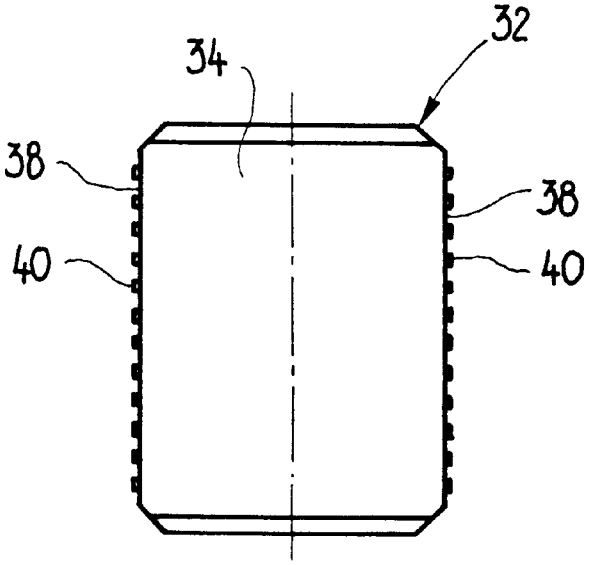
FIG. 5 is a view on an enlarged scale with respect to FIGS. 1 to 4, the clamping element shown in said FIGS. with two gripping surfaces and gripping teeth protruding over the latter.
Figure 6:
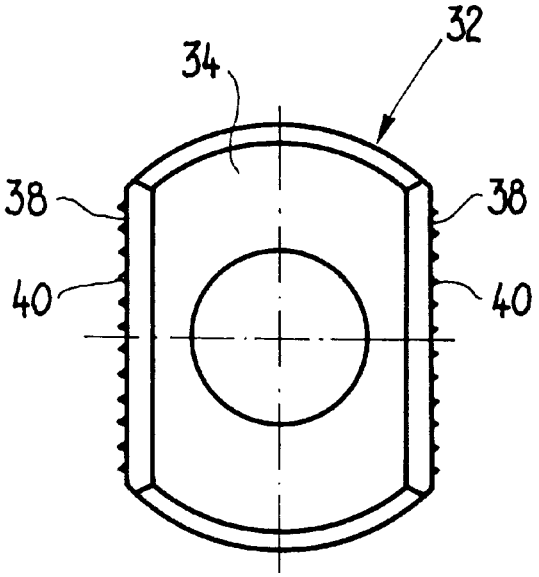
FIG. 6 is a side view of the clamping element of FIG. 5.
Figure 7:
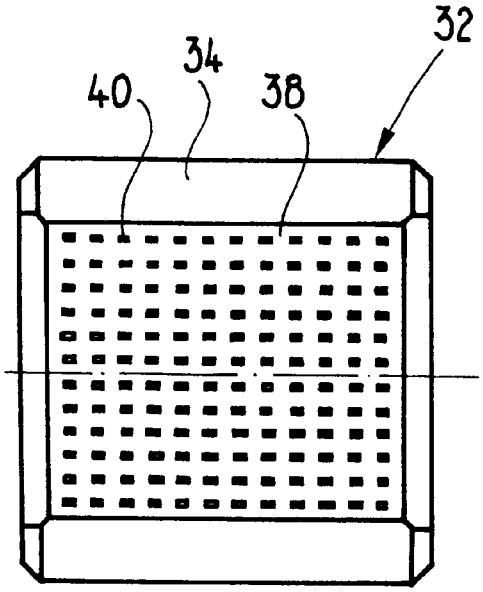
FIG. 7 is a plan view of the clamping element of FIGS. 5 and 6.

FIGS. 5 to 7 show the clamping body 34 of the tensioning device (shown in FIGS. 1 to 4) on an enlarged scale and in three different views. Over the two parallel, flat gripping surfaces 38 there protrudes a plurality of rows of gripping teeth 40 having a length of approximately 0.1 mm to 0.5 mm, preferably approximately 0.3 mm. It has been shown that this arrangement and design of the gripping teeth 40 results in the plastic band 24 being optimally secured to the plastic band 24 while being subject to a negligibly small amount of weakening. Should the gripping teeth 40 which are assigned to the active gripping surface 38 become worn, after the bearing spindle 36 is pulled out, the clamping body can be refitted by being rotated through 180°.

The tensioning device 10 functions as follows. When the tensioning element 12 is in the inoperative position (see FIG. 1) the plastic band 24, which is guided between the first flat region 16 and the clamping element 32 with play, is guided around an article to be strapped and is tightened against it. To tension the plastic band to the desired tensioning force, the shaft 14 is then rotated in the tensioning direction S. Since the distance from the axis 14' to that second flat region 18 of the tensioning element 12 which forms the gripping region 22 is greater than to the first flat region 16—measured at right angles with respect to the particular flat region—, the gripping region 22 is moved toward the gripping surface 38 of the clamping element 32 and catches hold of the plastic band 34 running between them. In this case, the gripping surface 38 of the rotatably mounted clamping element 32 is automatically directed parallel to the plastic band 24 and finally to the gripping region 22 of the tensioning element 12. The action of the tensile spring 46 means that the clamping element 32 remains supported in a positionally fixed manner against the stop 50 and is then pulled to push in a planar manner against the plastic band 24. The moment at which the plastic band 24 is gripped is shown in FIG. 2. When the shaft 14 is rotated further in the tensioning direction S, the plastic band 24 is automatically clamped between the tensioning element 12 and the clamping element 32 as a result of the non-positive and positive engagement and the action of the spring 46. The higher that the tensioning force is in the plastic band 24, the greater is the clamping force. The clamping element 32 is then rotated away from being supported against the stop 50 as a result of contact with the gripping regions. The shaft 14 is rotated further until the desired tensioning force in the plastic band 24 is obtained. This can be set by means of a friction coupling connected between the driving motor and the shaft 14. When the plastic band 24 is tensioned, it then extends tangentially to the circular cylindrical section 20 of the circumferential surface 20'. The embodiment shown of the tensioning device 10 permits a very large angle of rotation of the shaft and thus a great tensioning travel for the plastic band 24, namely until the bracket 28, in the tensioning direction S, has arrived at the guide channel 26.

Figure 8:
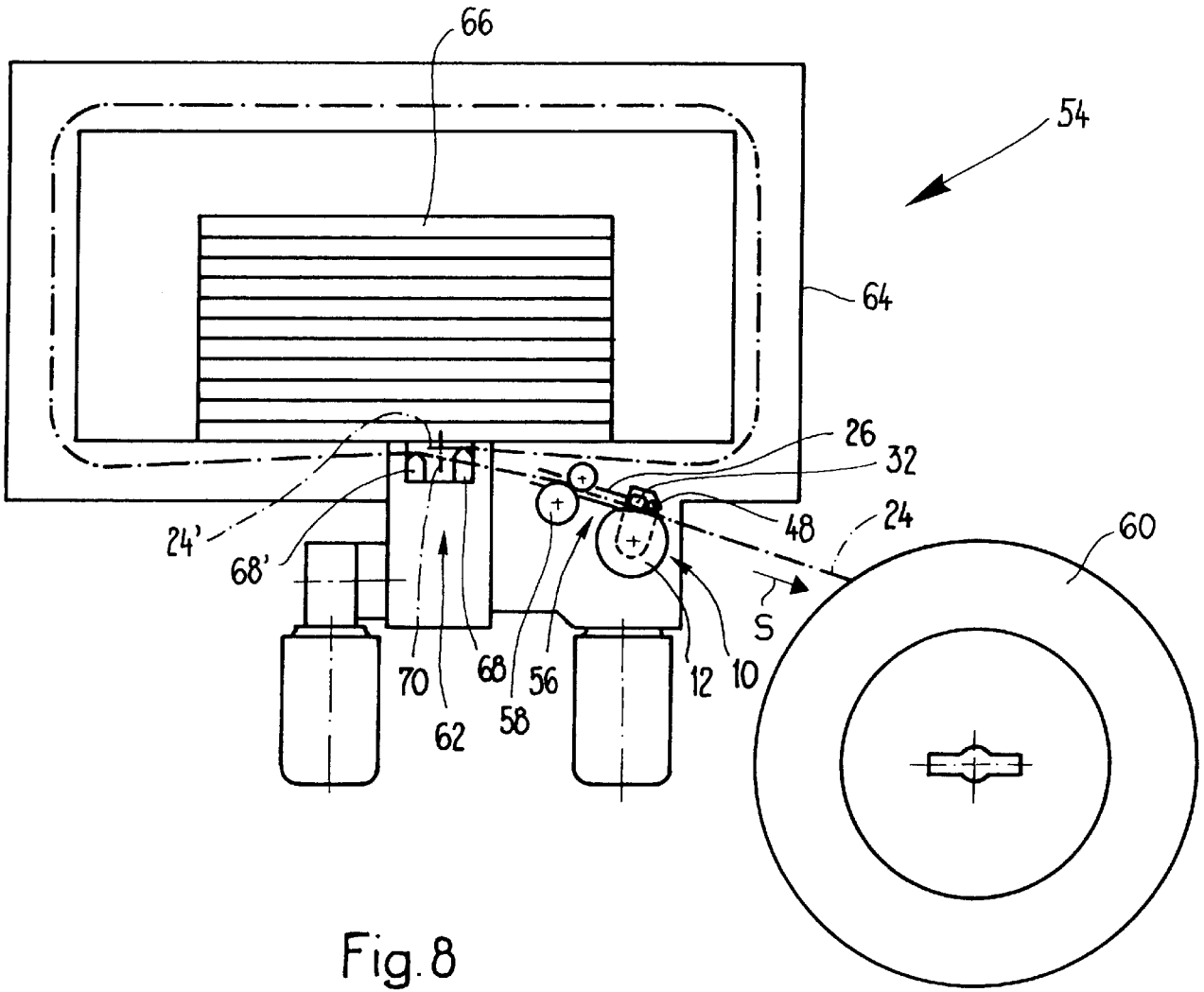
FIG. 8 is a side view of a strapping machine having a tensioning device as is shown in FIGS. 1 to 7.

FIG. 8 shows, in an extremely simplified manner, a strapping machine 54 whose band-introducing and tensioning assembly 56 has a tensioning device 10 (shown in FIGS. 1 to 4) for the final tensioning of the plastic band 24. In the region of the guide channel 26 there is, arranged a pair 58 of conveying rollers which is connected to a reversible drive. This pair is intended to insert the plastic band 24, which is coming from a take-off roller 60 and is guided through the tensioning device 10, through a clamping and sealing assembly 62, in a feeding direction which is opposed to the tensioning direction S, and with the free band end 24' in front, into a guide frame 64 until the band end 24' comes up against a stop in the clamping and sealing assembly 62. The guide frame 64 runs around the article to be strapped 66. The pair 58 of conveying rollers is furthermore intended to pull back the plastic band 24, which is guided around the article to be strapped 66 and is clamped, by means of a first band-clampin unit 68 of the clamping and sealing assembly 62, at a distance from the band end 24' which has come against the stop in the tensioning direction S until it has emerged, in a manner which is known, from the guide frame 64 and has positioned itself against the article to be strapped 66.

The clamping and sealing assembly 62 has a second band-clamping unit 68' and a welding unit 70 between the band-clamping units 68 and 68'. It is of known design.

After the pair of conveying rollers 58 has pulled the plastic band 24 back in the tensioning direction S and the band has positioned itself against the article to be strapped 61 the tensioning device 10 comes into operation. Starting from the inoperative position shown in FIGS. 8 and 1, the tensioning element 12 is rotated in the tensioning direction S and in process, as described above, the plastic band 24 is gripped and tensioned to the predetermined tensioning force. As soon as this is reached, the clamping and sealing assembly 62 comes into operation with the second band-clamping unit 68' clamping the plastic band 24 and the welding unit 70 welding the two overlapping sections of the plastic band together by heating and clamping. The plastic band 24 is then severed, likewise by means of the clamping and sealing assembly 62, downstream of the welding location, as seen in the tensioning direction S.

After the band-clamping units 68, 68' are released, the tensioning element 12 is rotated back counter to the tensioning direction S into the inoperative position and the pair 58 of conveying rollers is temporarily activated to advance the plastic band 24. In the inoperative position of the tensioning element 12, the plastic band 24 is released by the tensioning device 10 and is ready for renewed insertion into the guide frame 64, by means of the pair 58 of conveying rollers, to form the next strapping.

I claim:

1. A tensioning device in a strapping machine for a final tensioning of a plastic band guided around an article to be strapped and tightened against it, comprising:

a tensioning element which is rotatable about an axis in a tensioning direction out of an inoperative position and which has a gripping location;

a clamping element which is rotatable about said axis and has a gripping surface; and a stop which limits rotation of the clamping element counter to the tensioning direction, said plastic band being guided in a freely moveable manner between the tensioning element in the inoperative position and the gripping surface of the clamping element which is supported against the stop, the gripping surface and the gripping location being moved toward each other by rotation of the tensioning element with respect to the clamping element in the tensioning direction to hold the plastic band which runs between them, wherein the gripping surface and the gripping region are arranged parallel to each other so that the gripping location is a planar gripping region with planar clamping of the plastic band.

2. The tensioning device as claimed in claim 1, wherein the gripping surface and the gripping region are of approximately flat design.

3. The tensioning device as claimed in claim 1, wherein the clamping element includes a clamping body which has the gripping surface and which is mounted such that it can be rotated to a limited extent about a bearing spindle which is parallel to the axis of the tensioning element.

4. The tensioning device as claimed in claim 1, wherein the tensioning element and the clamping element are arranged concentrically and such that they can be rotated about the same axis.

5. The tensioning device as claimed in claim 1, wherein at the moment that the plastic band is gripped by the tensioning element and the clamping element, the gripping region, forms an angle with the direction of the plastic band running to the tensioning element, in a range of from 1° to 5°.

6. The tensioning device as claimed in claim 5, wherein said angle is in a range of 1.5° to 4°.

7. The tensioning device as claimed in claim 6 wherein said angle is 2.5°.

8. The tensioning device as claimed in claim 1, wherein, when bearing against the stop, the clamping element is arranged downstream in the tensioning direction with respect to a line perpendicular to the plastic band running to the tensioning element and through the axis of the tensioning element.

9. The tensioning device as claimed in claim 1, wherein the tensioning element is designed in the form of a roller with two flat regions, which follow one another in the circumferential direction, on the outer circumferential surface, wherein the flat region which is in front in the tensioning direction lies opposite the gripping surface of the clamping element when the tensioning element is in the inoperative position, and the trailing flat region forms the gripping region.

10. The tensioning device as claimed in claim 1, wherein a spring is arranged between the tensioning element and the clamping element, and a spring force of said spring acts on the clamping element counter to the tensioning direction.

11. The tensioning device as claimed in claim 1, wherein the clamping element has gripping teeth which protrude over the gripping surface and have a length of 0.1 mm to 0.5 mm.

12. The tensioning device as claimed in claim 11 wherein the gripping teeth have a length of 0.3 mm.

13. The tensioning device as claimed in claim 1, wherein the clamping element has at least two surfaces designed as gripping surfaces, one of said gripping surfaces being used for clamping.

* * * * *